US010501997B2

(12) United States Patent
Rindeskar

(10) Patent No.: US 10,501,997 B2
(45) Date of Patent: Dec. 10, 2019

(54) DRILL BIT WITH RECESSED CUTTING FACE

(71) Applicant: SANDVIK INTELLECTUAL PROPERTY AB, Sandviken (SE)

(72) Inventor: Andreas Rindeskar, Hofors (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 318 days.

(21) Appl. No.: 15/505,995

(22) PCT Filed: Jun. 15, 2015

(86) PCT No.: PCT/EP2015/063308

§ 371 (c)(1),
(2) Date: Feb. 23, 2017

(87) PCT Pub. No.: WO2016/030036

PCT Pub. Date: Mar. 3, 2016

(65) Prior Publication Data

US 2017/0268295 A1 Sep. 21, 2017

(30) Foreign Application Priority Data

Aug. 25, 2014 (EP) ..... 14182068

(51) Int. Cl.
*E21B 10/38* (2006.01)
*E21B 10/36* (2006.01)

(52) U.S. Cl.
CPC ..... *E21B 10/38* (2013.01); *E21B 10/36* (2013.01)

(58) Field of Classification Search
CPC . E21B 10/36; E21B 10/38; E21B 1/04; E21B 10/00
See application file for complete search history.

(56) References Cited

U.S. PATENT DOCUMENTS

| | | | | |
|---|---|---|---|---|
| 2,168,102 | A * | 8/1939 | Nast | E21B 10/36 175/417 |
| 3,357,507 | A | 12/1967 | Stewart | |
| 3,388,756 | A * | 6/1968 | Varel | E21B 10/56 175/418 |
| 3,955,635 | A * | 5/1976 | Skidmore | E21B 10/38 175/400 |
| 4,051,912 | A | 10/1977 | White | |
| 5,890,551 | A | 4/1999 | Liljebrand et al. | |
| 2002/0153174 | A1 | 10/2002 | Linden et al. | |
| 2008/0087473 | A1 | 4/2008 | Hall et al. | |
| 2013/0186693 | A1 * | 7/2013 | West | E21B 10/00 175/332 |

(Continued)

FOREIGN PATENT DOCUMENTS

| | | | |
|---|---|---|---|
| AU | 2012349363 | A1 | 6/2014 |
| DE | 2856205 | A1 | 7/1980 |
| DE | 9113785 | U1 | 1/1992 |

(Continued)

*Primary Examiner* — Caroline N Butcher
(74) *Attorney, Agent, or Firm* — Corinne R. Gorski

(57) ABSTRACT

A percussive rock drill bit includes a head having an annular gauge collar and a central island. An annular cutting channel is defined between the collar and the island such that specifically positioned cutting buttons are effective to create an annular ridge in the cut rock face having a reduced rock breaking resistance.

14 Claims, 7 Drawing Sheets

(56) References Cited

U.S. PATENT DOCUMENTS

2015/0136494 A1* 5/2015 Pearce ..... E21B 10/54
175/428

FOREIGN PATENT DOCUMENTS

| | | | |
|---|---|---|---|
| GB | 692373 | A | 6/1953 |
| GB | 2011286 | A | 7/1979 |
| RU | 2019674 | C1 | 9/1994 |
| WO | 2006033606 | A1 | 3/2006 |
| WO | 2006054933 | A1 | 5/2006 |
| WO | 2009067073 | A1 | 5/2009 |

* cited by examiner

DRILL BIT WITH RECESSED CUTTING FACE

RELATED APPLICATION DATA

This application is a § 371 National Stage Application of PCT International Application No. PCT/EP2015/063308 filed Jun. 15, 2015 claiming priority of EP Application No. 14182068.8, filed Aug. 25, 2014.

FIELD OF INVENTION

The present invention relates to a percussive rock drill bit having a head provided at a shank and configured with a recessed crushing face configured to create a ridge in the rock during cutting so as to reduce the rock breaking resistance.

BACKGROUND ART

Percussion drill bits are widely used both for drilling relatively shallow bores in hard rock and for creating deep boreholes. For the latter application, a drill string is typically used in which a plurality of rods are coupled end-to-end via threaded joints as the depth of the hole increases. A terrestrial machine is operative to transfer a combined impact and rotary drive motion to an upper end of the drill string whilst a drill bit positioned at the lower end is operative to crush the rock and form the boreholes. WO 2006/033606 discloses a typical drill bit comprising a drill head that mounts a plurality of hard cutting inserts, commonly referred to as buttons. Such buttons comprise a carbide based material to enhance the lifetime of the drill bit.

Fluid is typically flushed through the drill string and exits at the base of the borehole via apertures in the drill head to flush the rock cuttings from the boring region to be conveyed rearward through the bore around the outside of the drill string. Further examples of percussive drill bits are disclosed in U.S. Pat. No. 3,388,756; GB 692,373; RU 2019674; U.S. 2002/0153174; U.S. Pat. No. 3,357,507, U.S. 2008/0087473; U.S. Pat. No. 4,113,037; GB 2011286; U.S. Pat. No. 5,890,551; DE 2856205 and WO 2009/067073.

The effectiveness of the drill bit to bore into rock is dependent on the rocks breaking resistance that may be considered to include vertical and horizontal stresses imposed to the rock within the subterranean depth. Drill head design and construction is typically a compromise between maximising the drill bit operational lifetime and maximising the axially forward cutting performance. The drill bit must also facilitate rearward transport of the rock fragments within the borehole that would otherwise decrease forward cutting. Accordingly, what is required is a drill bit and in particular a bit head that is optimised to satisfy the above considerations.

SUMMARY OF THE INVENTION

It is an objective of the present invention to provide a drill bit and in particular a drill bit head for percussive rock drilling that is configured to create a specific topography within the rock that significantly reduces the rock breaking resistance and accordingly increases drilling performance and efficiency. It is a further specific objective to provide a drill bit head configured to be self-guiding during drilling. It is a yet further objective to provide a head that is effective to greatly facilitate the axially rearward transport of rock fragments from the rock face.

The objectives are achieved by providing a drill head with a recessed crushing face positioned radially between a perimeter gauge collar and a central island. In particular, cutting buttons are specifically positioned at the crushing face and respective shear faces that extend axially forward from the crushing face. The present configuration is effective to create a particular ridged topography in the rock that is very susceptible to cracking and fracture to significantly decrease the rock breaking resistance. In particular, the present drill head is configured to create a single annular ridge at the rock face immediately in front of the crushing face of the head to increase the available fracturing directions of the rock at the ridge when impacted by the crushing face mounted buttons.

The as-formed rock ridge is also effective to assist in stabilising and guiding the bit head to reduce lateral deflections due to anomalies such as existing fractures within the rock structure.

The present bit head is also configured with radially and circumferentially extending flushing grooves that interrupt the gauge collar to allow the radially outward and axially rearward transport of the flushings and fines. The present annular channel or groove, recessed in the bit head, is effective to direct the flushing fragments through notches in the gauge collar for optimised axial rearward transport along the borehole.

According to a first aspect of the present invention there is provided a percussive rock drill bit head provided at one end of an elongate shank having an internal bore extending axially from one end of the shank towards the head, the head comprising: an axially forward facing annular crushing face; a generally annular gauge collar projection axially forward from the crushing face at a perimeter of the head and having a gauge surface positioned axially forward of the crushing face; a central island being axially raised from the crushing face and having a front face positioned axially forward from the crushing face; a first and second generally annular shear face extending axially between the crushing face and the gauge face and the crushing face and the front face respectively; at least one cutting button provided respectively on each of the crushing, gauge, front and first and second shear faces; flushing grooves in communication with the internal bore and extending radially outward from the island towards and through the gauge collar to separate the gauge collar into collar segments; and an annular channel being defined between the island and the gauge collar configured to create an annular ridge in the rock and accordingly reduce the rock breaking resistance.

The present bit is configured to create a hole topography comprising shelves and ridges that have lower k-values (rock breaking resistance) such that the cutting buttons mounted at the crushing face have significant reduced k-values than other buttons of the drill head. The total k-value of the present drill head is significantly lower (of the order of 20% less) than that of existing bits due to the specific grouping and positioning of the cutting buttons at respective gauge, front, crushing and shear faces that interact with synergy during cutting. Accordingly, by reducing the rock k-value the present bit head is configured to drill greater diameter boreholes with less power consumption (or in less time using the same power) with respect to known bits.

Optionally, the crushing face is substantially planar or concave relative to a plane extending perpendicular to a longitudinal axis of the shank. A concave crushing face is advantageous to further increase the axial depth of the groove and accordingly increase the axial height of the as-formed annular ridge within the rock to reduce the rock breaking resistance.

Preferably, the flushing grooves extend radially inward within regions of the island. Additionally, and preferably the flushing grooves are recessed into the crushing face. A desired flow path for the flushing fluid from a central region of the head to the head perimeter is accordingly created to entrain rock particles and debris to flow radially outward and axially rearward from the head. The various notches at the island and the collar greatly facilitate flushing and prevent the flushing slurry flowing along an extended flow path in the circumferential direction around the head.

Preferably, the front face is positioned axially forward of the gauge face. Such an arrangement is advantageous to stabilise the forward drilling and to maximise the axial length of the annular ridge formed with the rock to produce the rock breaking resistance.

Preferably, the front face comprises an axial depression to provide a fluid flow pathway between radially inner regions of the flushing grooves. The axial depression accordingly provides a recessed pocket for the flow of flushing fluid to facilitate the radially outward and axially rearward transport of rock fines from the centre of the head.

Preferably, the head comprises flushing bores in communication with the internal bore and extending through the gauge collar to exit at the gauge face. The flushing bores within the collar act to further facilitate radially outward and axially rearward flushing are beneficial to maximise crushing performance and efficiency.

Optionally, the first and second shear faces are inclined to extend transverse to a longitudinal axis of the shank. Optionally, the first and second shear faces may be aligned parallel to the longitudinal axis or comprise annular sections aligned parallel to the axis with other annular sections being aligned transverse to the axis. That is, the first and second shear faces may each comprise a plurality of faces being angularly disposed relative to one another. The shear faces are configured to create the desired topography in the cut rock having an unstable ridge that is susceptible to breaking.

Where the first and/or second shear faces are inclined relative to the axis, the angle by which the first shear face may be inclined relative to the axis is in the range 1 to 20°. Optionally, the angle by which the second shear face may be inclined relative to the axis is in the range 20 to 40°.

Optionally, along a radius extending from a centre of the head to a radially outermost perimeter, a separation distance between a radially innermost part of a cutting button on the first shear face and a radially outermost part of a closest cutting button on the second shear face is in the range 10 to 30% of the radius of the head. Optionally, the range is 15 to 25% or more preferably 18 to 22%.

Optionally, a radial distance of the crushing face defined between the first and second shear faces is 5 to 20% of a radius of the head defined between a centre of the head and a radially outermost perimeter part of the cutting buttons at the gauge collar. Optionally, the range is 10 to 15% and more preferably 11 to 14%.

Optionally, an axial separation distance between the front face and the crushing face is in the range 25 to 45% of an axial length of the head defined between an axially forwardmost part of the cutting button at the front face and an axially rearwardmost part of a skirt that represents an axially rearwardmost part of the gauge collar extending directly from the shank. Preferably, the range is 30 to 40% and more preferably 33 to 38%.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
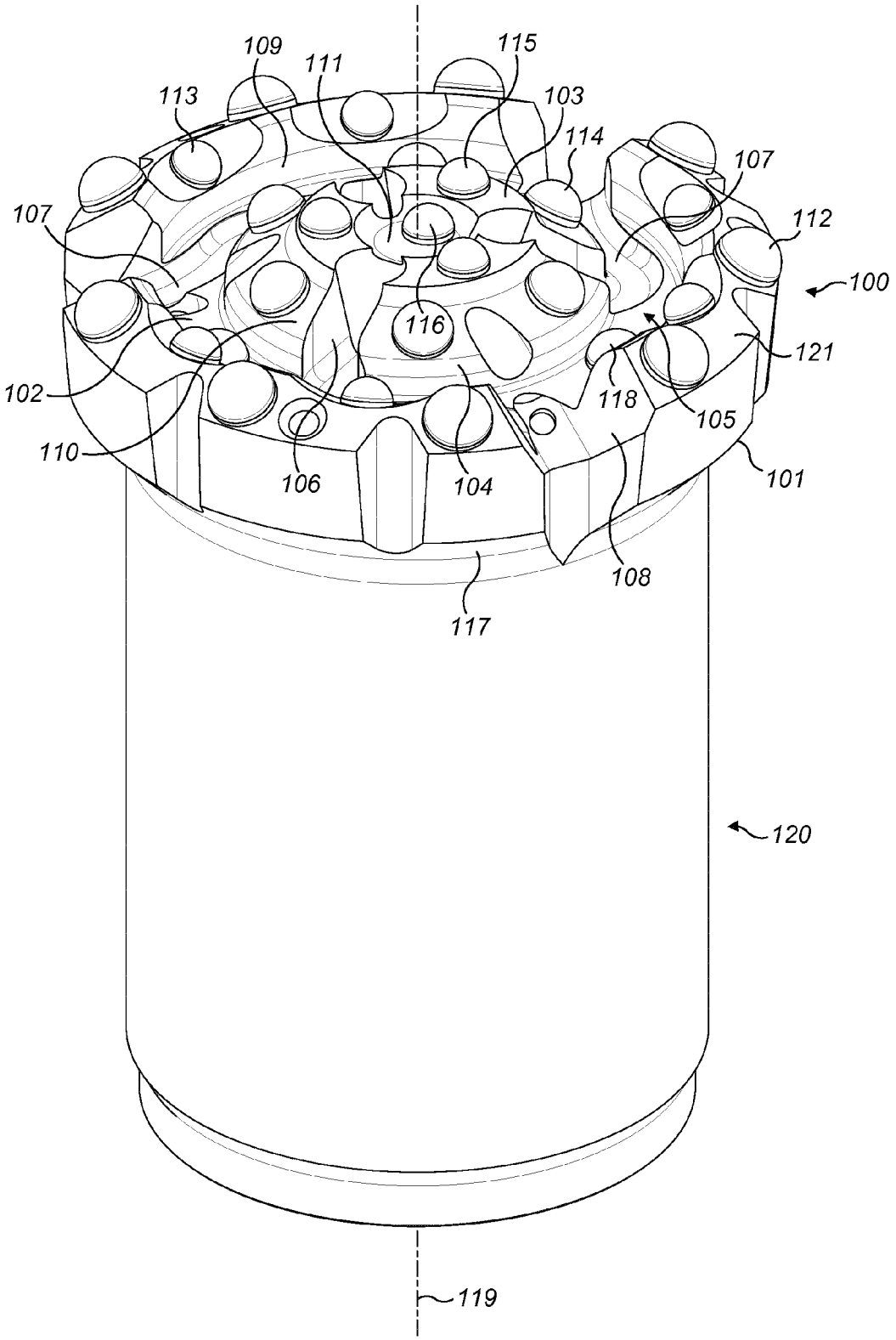
FIG. 1 is an external perspective view of a percussive rock drill bit having a head and a shank with a plurality of cutting buttons mounted over the head according to a specific implementation of the present invention.
Figure 2:
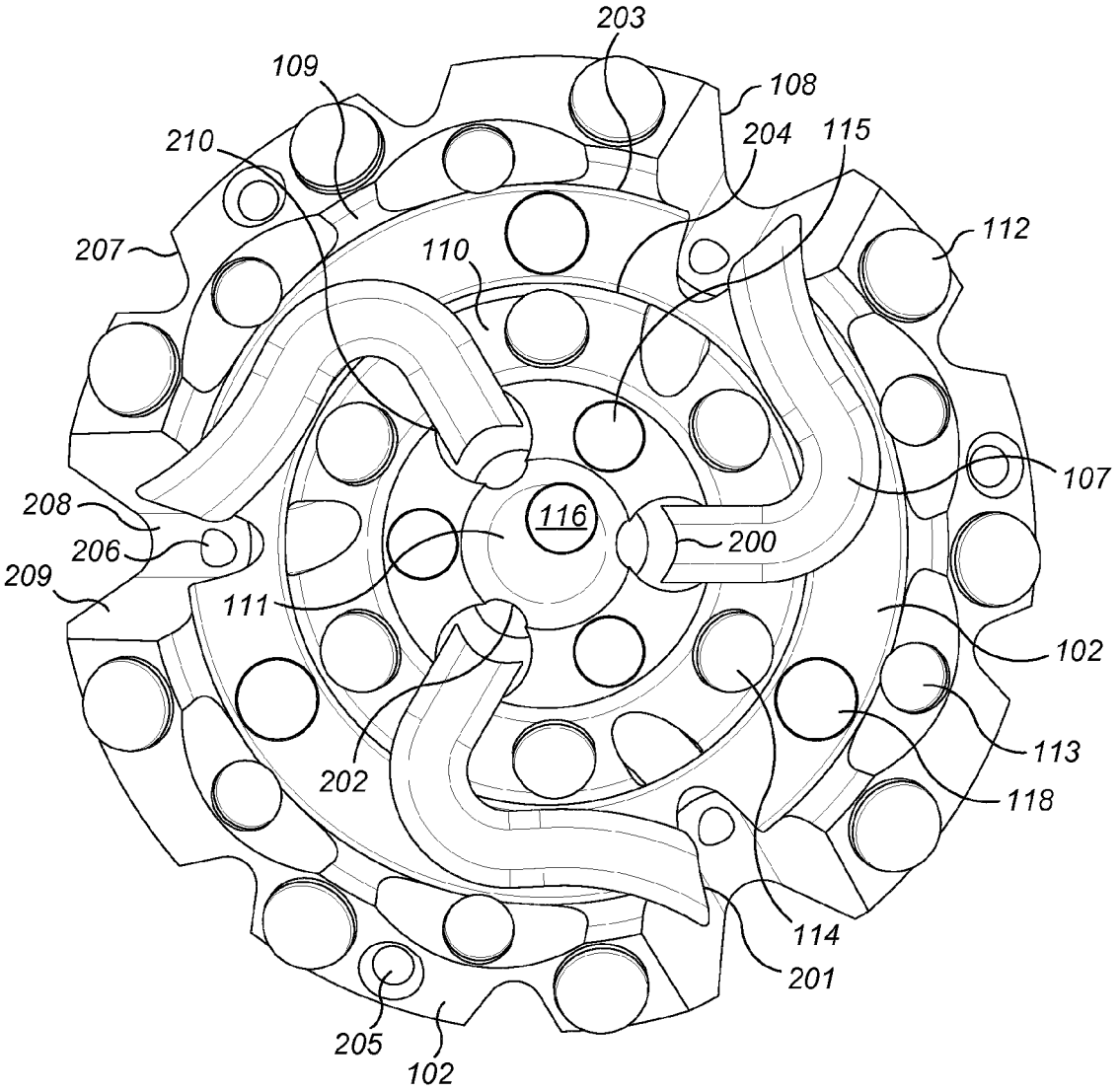
FIG. 2 is a plan view of the bit head of FIG. 1.
Figure 3:
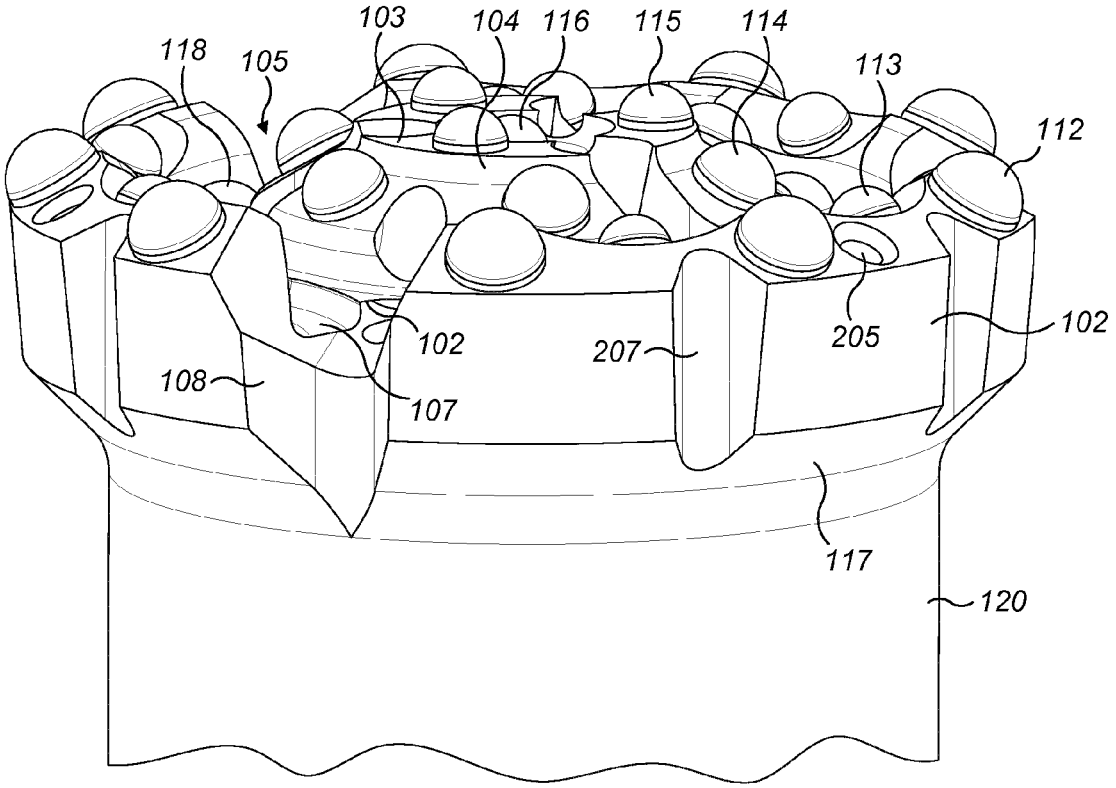
FIG. 3 is a further perspective view of the bit head of FIG. 1.
Figure 4:
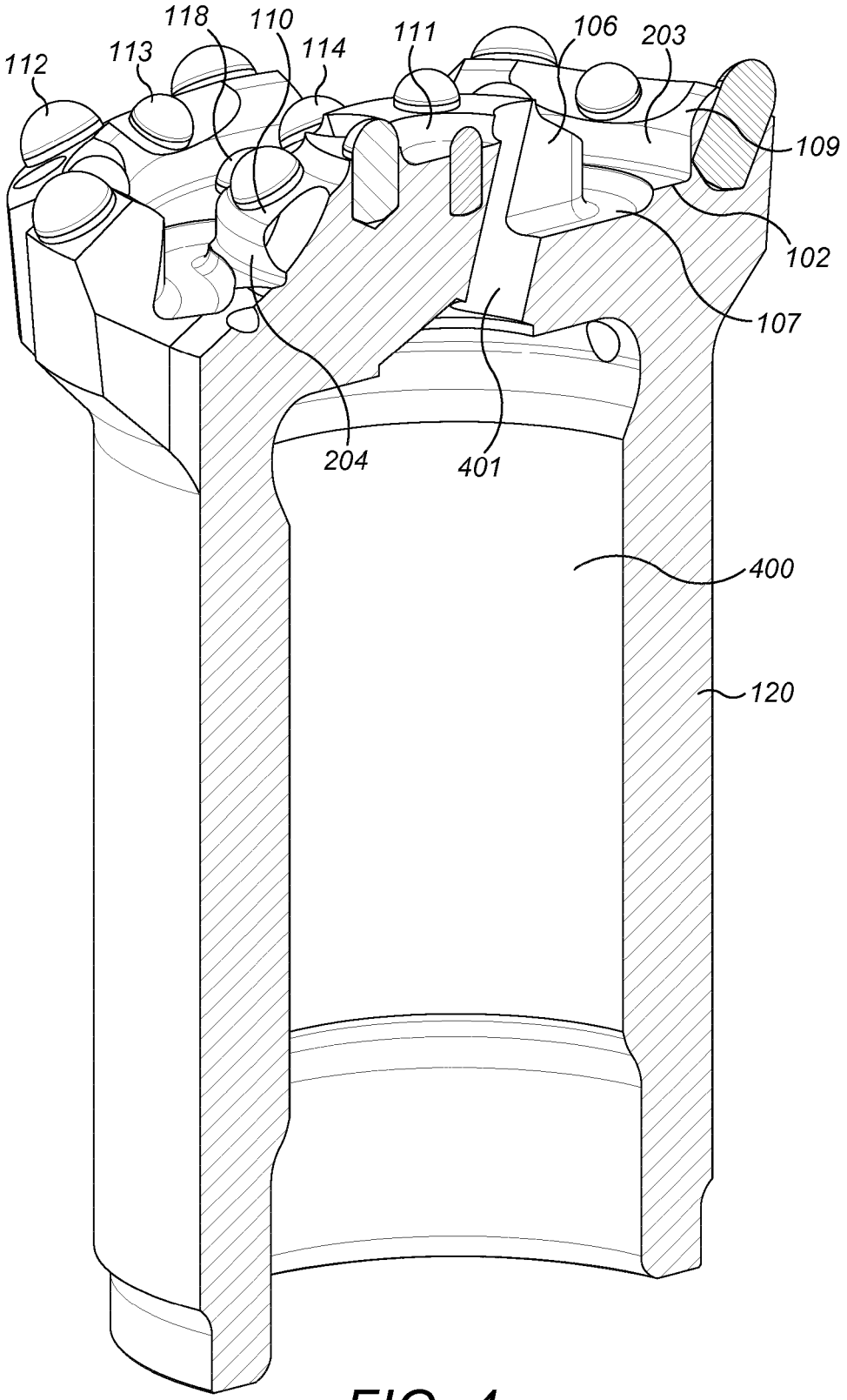
FIG. 4 is a perspective cross sectional view of the bit head of FIG. 1.

Referring to FIGS. 1 to 4, a percussive drill bit comprises an elongate shank 120 having a drill head 100 provided at one end. Head 100 is flared generally radially outward from shank 120 and comprises a gauge collar 101 formed at a perimeter and a raised central island indicated generally by reference 104 to define an annular channel (indicated generally by reference 105) located radially between collar 101 and island 104.

Gauge collar 101 comprises a skirt 117 that flares radially outward from shank 120 to form an annular junction between head 100 and shank 120. Collar 101 comprises a forward facing gauge face 121 being declined to slope downwardly away from a central longitudinal axis 119 extending through shank 120 and head 100. Collar 101 is divided in a circumferential direction into three arcuate collar segments being separated by generally v-shaped notches 108 that project axially rearward from gauge face 121 towards shank 120. A plurality of gauge buttons 112 are distributed on the gauge face 121 of each collar segment and are orientated to tilt radially outward from axis 119. A plurality of sludge grooves 207 are also recessed into the perimeter of collar 101 to facilitate rearward transport of debris cut from the rock face. A radially innermost side of gauge face 121 is terminated by a first shear face 109 aligned transverse to gauge face 121 and being generally inclined to slope upwardly from axis 119. First shear face 109 extends axially forward from a substantially planar crushing face indicated generally by reference 102. Crushing face 102 is generally annular and extends circumferentially around central island 104 to represent a trough or base of the recessed annular channel 105 defined radially between island 104 and collar 101. A plurality of crushing buttons 118 are distributed circumferentially over crushing face 102. Crushing face 102 is terminated at its radially innermost end by a second shear face 110 extending axially forward from face 102 to define a perimeter of island 104. First and second shear faces 109, 110 are positioned radially opposed one another and collectively define channel 105 such that channel 105 comprises an axial depth being approximately equal to an axial height of collar 101 and island 104. However, according to the specific implementation, an axial height of island 104 is greater than the axial distance by which collar 101 extends forward from crushing face 102.

Each of the first and second shear faces 109, 110 comprises respective sets of shear buttons 113, 114. Second shear face 110 is also aligned transverse to axis 119 such the opposed shear faces 109, 110 define at least part of a generally v-shaped circumferentially extending channel. Accordingly, the respective first and second sets of shear buttons 113, 114 are orientated to be tilted axially inward and outward relative to axis 119, respectively.

Island 104 comprises a generally circular configuration in a plane perpendicular to axis 119 having a generally dome shaped profile in an axial plane extending through head 100. An axially forwardmost end of second shear face 110 is terminated by an annular front face 103 being generally planar and positioned perpendicular to axis 119 and aligned parallel to crushing face 102. A recess 111 is indented into front face 103 being positioned centrally within head 100 such that central island 104 comprises a slightly recessed cavity at its axially forwardmost apex region. A plurality of front buttons 115 are provided on front face 103 and a single front button 116 is mounted to project from a base of recess 111.

A plurality of notches 106 extend in a generally radial direction to be indented within island 104 at circumferentially spaced apart positions. Each notch 106 comprises a radially innermost first end 202 that terminates at the region of recess 111 whilst a radially outermost part 210 terminates at the radially innermost end of crushing face 102. A plurality of curved grooves indicated generally by reference 107 extends in both the radial and circumferential directions to be recessed within crushing face 102. Each groove 107 comprises a radially innermost first end 200 and a radially outermost second end 201. First end 200 is positioned within a respective island notch 106 whilst second end 201 is located within a respective v-shaped notch 108 at gauge collar 101. Accordingly, notches 106, 108 and grooves 107 collectively define flushing grooves to facilitate the radial and axially rearward transport of rock fragments and fines created during drilling. Each island notch 106 is terminated at its radially innermost end by an axially projecting bore 401 that is provided in fluid communication with a larger central bore 400 extending axially through shank 120. Accordingly, flushing fluid (typically air) may be supplied to head 100 via bores 400, 401 to emerge at island notches 106. Accordingly, the fluid is configured to circulate within channel 105 (and grooves 107) to exit head 100 via the v-shaped notches 108 together with the entrained rock fragments.

To facilitate the rearward transfer of flushings, a plurality of boreholes 205 are provided through head 100 to extend between central bore 400 and to emerge at gauge face 121. The rearward and radially outward transport of the flushing fluid may also be facilitated by cavities 206 formed at a trough region 208 of each v-shaped notch 108. Each notch 108 is further defined by a pair of opposed and axially converging side faces 209.

Each of the first and second shear faces 109, 110 comprises trailing annular end faces 203 and 204 respectively. Each end face 203, 204 forms an axial junction between crushing face 102 and each of the sloping shear faces 109, 110. End faces 203, 204 are aligned parallel with axis 119 and generally perpendicular to crushing face 102 to define the axially lowermost trough region of channel 105 in combination with crushing face 102.

Figure 5:
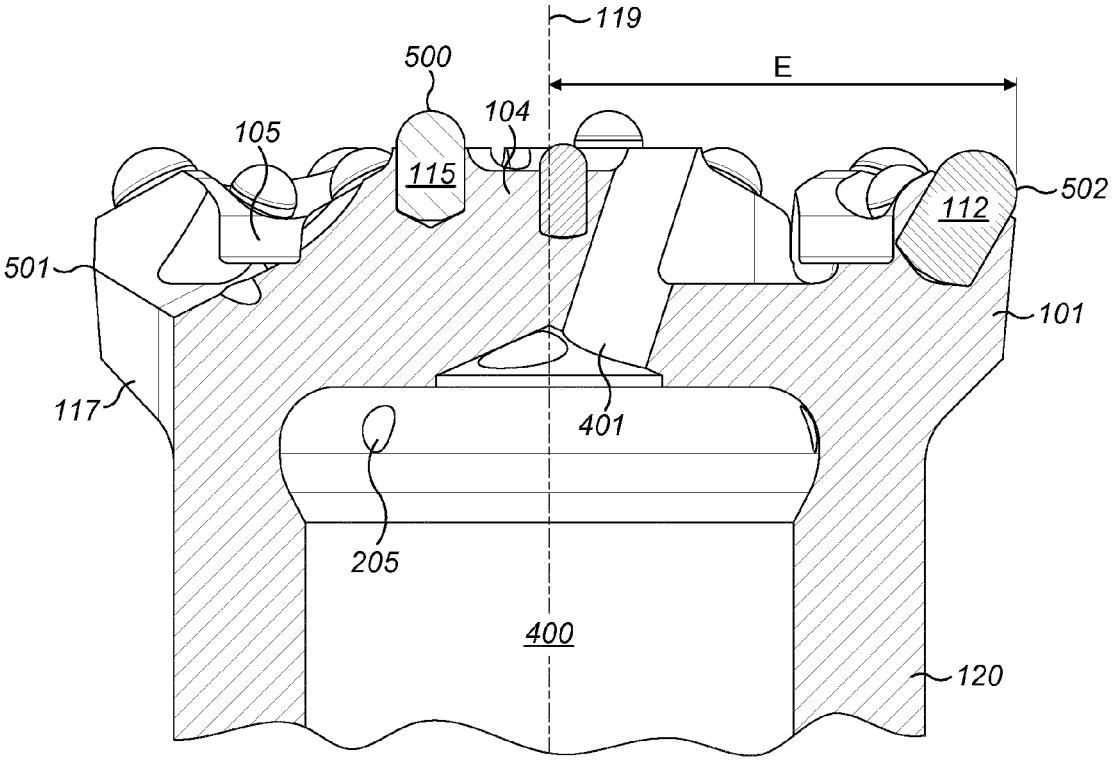
FIG. 5 is a side elevation cross sectional view of the bit head of FIG. 1.
Figure 6:
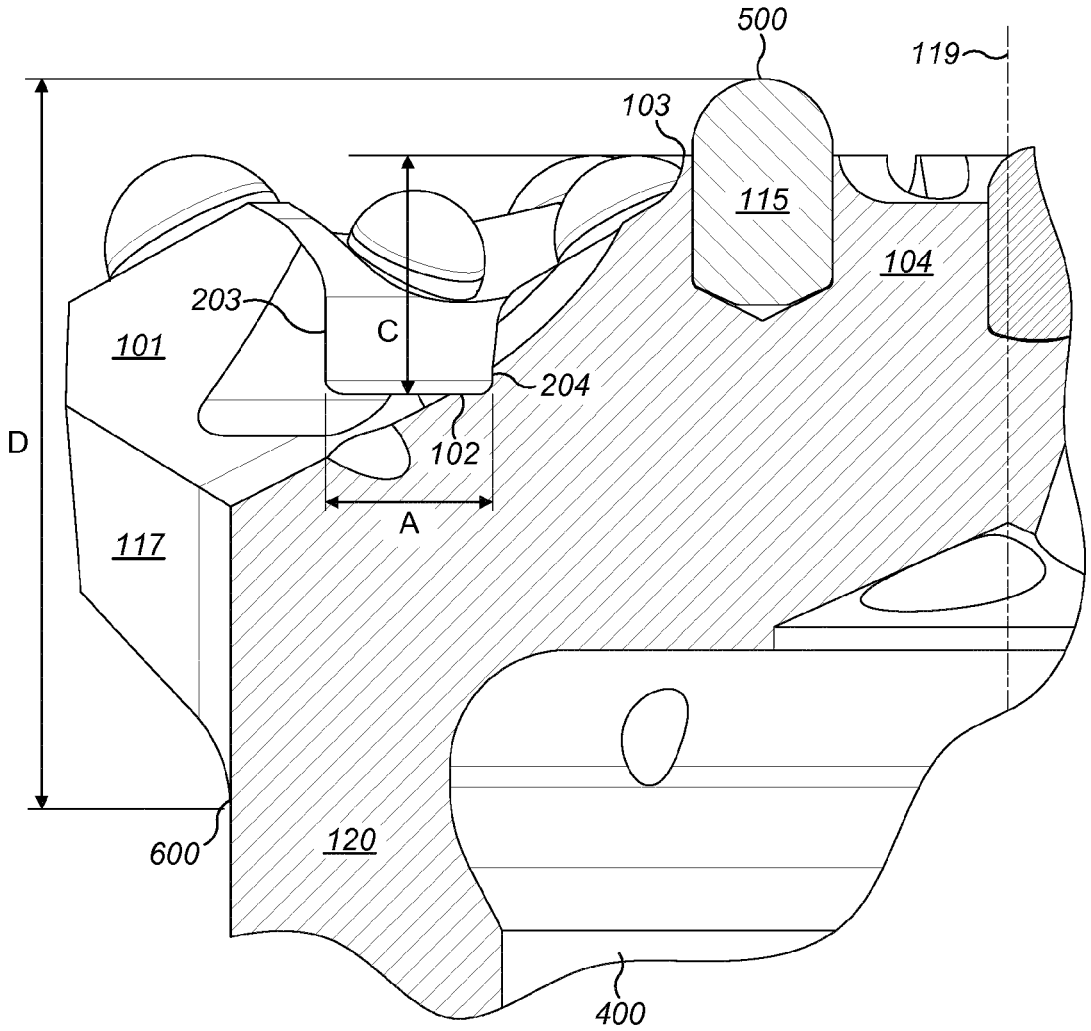
FIG. 6 is a magnified cross sectional view of a part of the bit head of FIG. 1.
Figure 7:
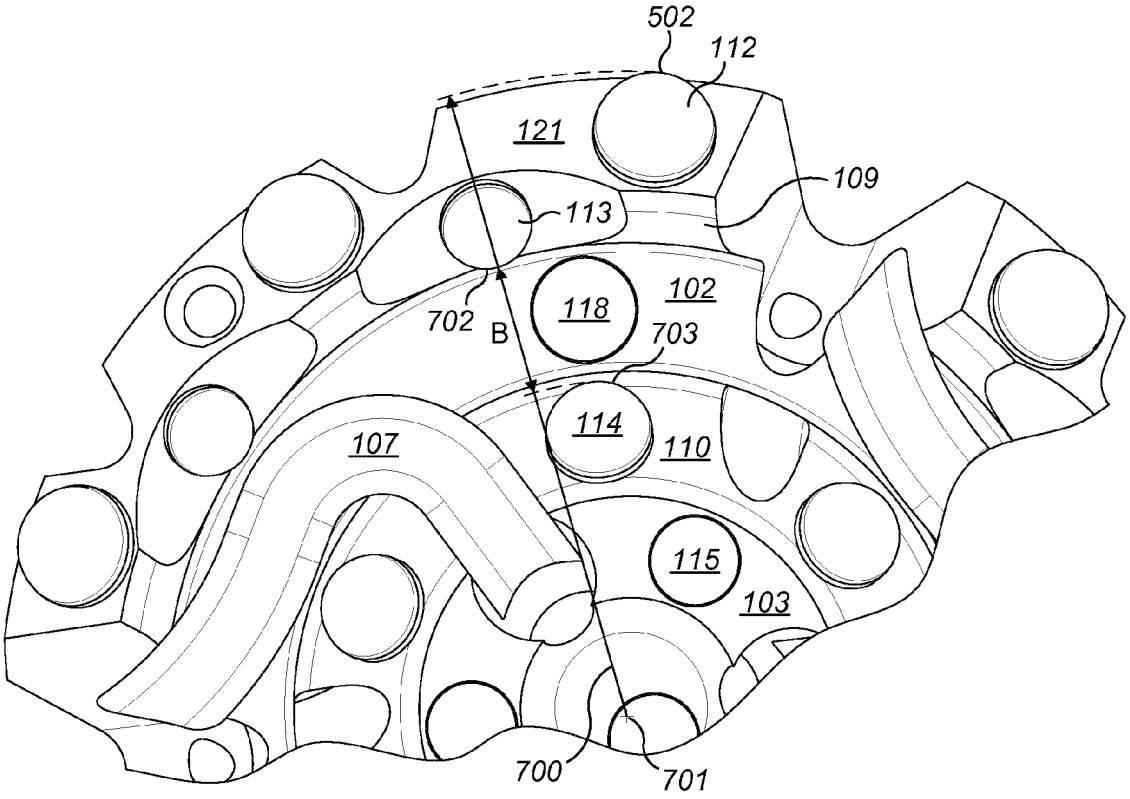
FIG. 7 is a magnified plan view of a part of the bit head of FIG. 1.

Referring to FIGS. 5 to 7, an axially forwardmost region of head 100 is defined by the respective apex regions 500 of front buttons 115 projecting from front face 103. Additionally, a radially outermost perimeter of head 100 is defined by a radially outermost region 502 of each gauge button 112. Gauge button regions 502 project radially beyond a radially outermost perimeter edge 501 of gauge collar 101 such that gauge buttons 112 determine the diameter of the borehole during cutting. Accordingly, a radial length of head 100 between central axis 119 and the perimeter of head 100 (as determined by the gauge button region 502) is represented by reference E.

Referring to FIG. 6, an axial length, represented by reference D, corresponds to an axial separation distance between the axially forwardmost region 500 of each front button 115 and an axially rearwardmost region 600 of skirt 117 provided at the axial junction with shank 120. Additionally, an axial separation distance between front face 103 and crushing face 102 is represented by reference C. Additionally, a radial separation distance between the opposed parallel first and second end faces 203, 204 is represented by reference A that corresponds to a radial length of crushing face 102.

Referring to FIG. 7 a radial separation distance (indicated by reference B) corresponds to the radial separation between a radially innermost part 702 of first shear button 113 and a radially outermost part 703 of a second shear button 114 that is located closest to the reference first shear button 113. The separation distance B lies on the radial line segment 700 being a straight line between the axial centre 701 of head 100 and the head radially outermost perimeter defined by gauge button region 502. As buttons 113 and 114 do not lie on the same radial line segment, the radially innermost point of separation distance B may be considered to be defined by an imaginary arcuate line extending from part 703 of second shear button 114 as illustrated in FIG. 7.

According to the specific implementation, radial distance A is approximately 11 to 14% of radial distance E and radial distance B is approximately equal to 18 to 22% of radial distance E. Additionally, axial length C is approximately equal to 34 to 37% of axial length D.

Additionally, and according to the specific implementation, head 100 comprises three collar segments each comprising three gauge buttons 112 and two first shear buttons 113. Second shear face 110 comprises six second shear buttons 114, whilst crushing face 102 comprises three crushing buttons 118. Additionally, the annular front face 103 comprises three front buttons 115 with recess 111 comprising a single front button 116. Gauge buttons 112 are generally larger than the crushing buttons 118 that are in turn larger than the first and second shear buttons 113, 114. Additionally, front buttons 115, 116 are generally smaller than first and second shear buttons 113, 114.

In use, head 100 is rotated about axis 119 and advanced axially forward to cut into the rock structure. A ridge within the rock is created during forward advancement by the cooperation between the opposed first and second shear buttons 113, 114 with the ridge being defined within the annular channel 105 between gauge collar 101 and central island 104. The present head 100 is advantageous to increase the rate of forward drilling and/or to minimise power draw by appreciably lowering the rock breaking resistance (k-value) due to the specific topography created at the rock face by the contours within head 100. That is, the specific positioning and orientation of the crushing 118 and shear 113, 114 buttons, generates an unstable annular ridge at the rock that exhibits at least four directions of breaking when contacted by crushing buttons 118. As will be appreciated, the specific topography of the annular ridge may be selectively adjusted by variation of the size and position of the crushing 102 and shear 113, 114 buttons and accordingly the geometrical relationship between the crushing face 102 and the first and second shear faces 109, 110.

The invention claimed is:

1. A percussive rock drill bit head provided at one end of an elongate shank having an internal bore extending axially along a longitudinal axis from one end of the shank towards the head, the head comprising:

an axially forward facing annular crushing face;

a generally annular gauge collar projecting axially forward from the crushing face at a perimeter of the head and having a gauge face positioned axially forward of the crushing face;

a central island being axially raised from the crushing face and having a front face positioned axially forward from the crushing face;

a first and second generally annular shear face extending axially between the crushing face and the gauge face and the crushing face and the front face respectively, wherein the first and second shear faces are inclined at an angle to extend transverse to the longitudinal axis of the shank;

at least one cutting button provided on each of the crushing, gauge, front and first and second shear faces;

a plurality of curved flushing grooves in communication with the internal bore and extending radially outward from the island towards and through the gauge collar to separate the gauge collar into collar segments; and an annular channel being defined between the island and the gauge collar configured to create an annular ridge in the rock and accordingly reduce the rock breaking resistance.

2. The head as claimed in claim 1, wherein the crushing face is substantially planar or concave relative to a plane extending perpendicular to a longitudinal axis of the shank.

3. The head as claimed in claim 1, wherein the plurality of curved flushing grooves extend radially inward within regions of the island.

4. The head as claimed in claim 1, wherein the plurality of curved flushing grooves are recessed into the crushing face.

5. The head as claimed in claim 1, wherein the front face is positioned axially forward of the gauge face.

6. The head as claimed in claim 1, wherein the front face includes an axial depression to provide a fluid flow pathway between radially inner regions of the flushing grooves.

7. The head as claimed in claim 1, further comprising a plurality of flushing bores in communication with the internal bore and extending through the gauge collar to exit at the gauge face.

8. The head as claimed in claim 1, wherein the angle by which the first shear face is inclined relative to the longitudinal axis is in the range 1 to 20°.

9. The head as claimed in claim 1, wherein the angle by which the second shear face is inclined relative to the longitudinal axis is in the range 20 to 40°.

10. The head as claimed in claim 1, wherein along a radius extending from a centre of the head to a radially outermost perimeter, a separation distance between a radially innermost part of a cutting button on the first shear face and a radially outermost part of a closest cutting button on the second shear face is in the range 10 to 30% of the radius.

11. The head as claimed in claim 10, wherein said range is 15 to 25%.

12. The head as claimed in claim 1, wherein a radial distance of the crushing face defined between the first and second shear faces is 5 to 20% of a radius of the head defined between a centre of the head and a radially outermost perimeter part of the cutting buttons at the gauge collar.

13. The head as claimed in claim 1, wherein an axial separation distance between the front face and the crushing face is in the range 25 to 45% of an axial length of the head defined between an axially forwardmost part of the cutting button at the front face and an axially rearwardmost part of a skirt that represents an axially rearwardmost part of the gauge collar extending directly from the shank.

14. The head as claimed in claim 13, wherein said range is 30 to 40%.

* * * * *